US005708925A

United States Patent [19]

Kobayashi et al.

[11] Patent Number: 5,708,925

[45] Date of Patent: Jan. 13, 1998

[54] DEVELOPING AGENT SUPPLY CONTAINER, PROCESS CARTRIDGE, AND ELECTROPHOTOGRAPHIC IMAGE FORMING APPARATUS

[75] Inventors: Kazunori Kobayashi; Kazumi Sekine, both of Kawasaki; Shinichi Sasaki, Fujisawa; Isao Ikemoto, Kawasaki, all of Japan

[73] Assignee: Canon Kabushiki Kaisha, Tokyo, Japan

[21] Appl. No.: 604,408

[22] Filed: Feb. 21, 1996

[30] Foreign Application Priority Data

Feb. 23, 1995 [JP] Japan ..... 7-058207

[51] Int. Cl.[6] ..... G03G 15/06

[52] U.S. Cl. ..... 399/120; 222/DIG. 1; 399/106

[58] Field of Search ..... 355/200, 260; 222/DIG. 1; 399/106, 120, 119; 141/192, 193

[56] References Cited

U.S. PATENT DOCUMENTS 4,708,455 11/1987 Kubota et al. ..... 355/3 R
5,153,650 10/1992 Maeshima ..... 355/260
5,294,960 3/1994 Nomura et al. ..... 355/210
5,351,728 10/1994 Ban et al. ..... 222/DIG. 1 X
5,475,467 12/1995 Watanabe et al. ..... 355/200
5,513,679 5/1996 Yamada ..... 222/DIG. 1 X

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

This invention relates to developing agent supply container for supplying a developing agent to a developing agent storage container for storing the developing agent used for developing a latent image formed on an electrophotographic photosensitive body. The container includes a developing agent storage portion, and an inhibition device for inhibiting supply of the developing agent stored in the developing agent storage portion to the developing agent storage container when the developing agent supply container is removed from a predetermined position, and permitting supply of the developing agent stored in the developing agent storage portion to the developing agent storage container when the developing agent supply container is mounted at the predetermined position with respect to the developing agent storage container so as to supply the developing agent to the developing agent storage container.

31 Claims, 8 Drawing Sheets

DEVELOPING AGENT SUPPLY CONTAINER, PROCESS CARTRIDGE, AND ELECTROPHOTOGRAPHIC IMAGE FORMING APPARATUS

BACKGROUND OF THE INVENTION

1. Field of the Invention

The present invention relates to a developing agent supply container, a process cartridge, and an electrophotographic image forming apparatus.

Note that the process cartridge is a cartridge which is obtained by integrating a charging means, and developing means or cleaning means, as image formation process means, with an electrophotographic photosensitive body or member, and is detachably attached to an electrophotographic image forming apparatus main body such as an electrophotographic copying machine, an electrophotographic printer, a wordprocessor, and the like, a cartridge which is obtained by integrating at least one of the charging means, developing means, and cleaning means as the process means with the electrophotographic photosensitive body, and is detachably attached to the main body of electrophotographic image forming apparatus, or a cartridge which is obtained by integrating the developing means as the process means with the electrophotographic photosensitive body, and is detachably attached to the electrophotographic image forming apparatus main body.

2. Related Background Art

In an image forming apparatus such as an electrophotographic copying machine, an electrophotographic printer, or the like, using an electrophotographic recording method, the surface of an electrophotographic photosensitive body is uniformly charged, the photosensitive body is exposed to light bearing image information to form an electrostatic latent image thereon, a developing agent is attached to the latent image using a developing means to form a visible image (toner image), and the toner image is transferred to a recording medium to obtain an image. In such apparatus, the electrophotographic photosensitive body, the charging means, the developing means, the cleaning means, and the like, are integrated into a frame member as a cartridge, and the user can attach/detach the process cartridge to/from the image forming apparatus main body, thereby allowing easy maintenance of the apparatus.

The present invention further develops such a process cartridge.

SUMMARY OF THE INVENTION

It is an object of the present invention to provide a developing agent supply container free from inadvertent leakage of the developing agent, a process cartridge which can supply a developing agent using the developing agent supply container, and an electrophotographic image forming apparatus.

It is another object of the present invention to provide a developing agent supply cartridge which supplies a developing agent only when it is attached at a predetermined position, a process cartridge which can supply a developing agent using the developing agent supply container, and an electrophotographic image forming apparatus.

It is still another object of the present invention to provide a developing agent supply container comprising a developing agent storage portion, and inhibition means for inhibiting supply of the developing agent stored in the developing agent storage portion to the developing agent storage container when the developing agent supply container is detached from the predetermined position, and permitting the supply of the developing agent stored in the developing agent storage portion to the developing agent storage container when the developing agent supply container is attached at the predetermined position with respect to the developing agent storage container so as to supply the developing agent to the developing agent storage container, a process cartridge to which the developing agent supply container can be attached, and an electrophotographic image forming apparatus to which the process cartridge can be attached,

DETAILED DESCRIPTION OF THE PREFERRED EMBODIMENTS

An electrophotographic image forming apparatus, a process cartridge and developing device, and a developing agent supply container according to the present invention will be described in detail below with reference to the accompanying drawings.

First Embodiment

Figure 2:
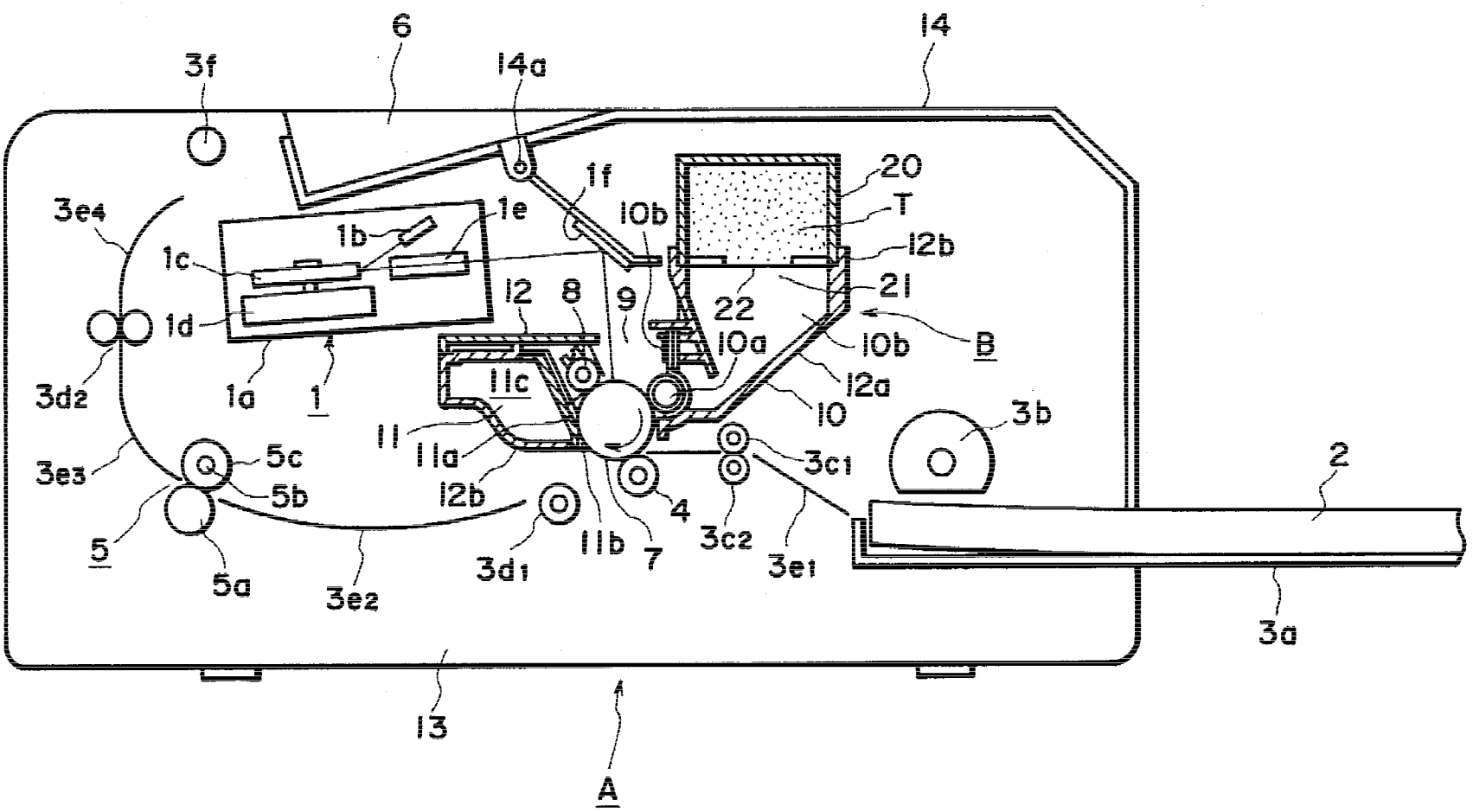
FIG. 2 is a sectional view showing the overall arrangement of an image forming apparatus to which a process cartridge is attached.

An embodiment of an electrophotographic image forming apparatus to which a process cartridge with the arrangement of the present invention can be detachably attached or removably mounted will be described below with reference to FIG. 2. The overall arrangement of the apparatus to which the process cartridge is attached will be explained, and then, the arrangements of the respective portions of an electrophotographic image forming apparatus A and a process cartridge B will be explained. Thereafter, the characteristic feature portion of the present invention will be explained.

<Overall Arrangement>

The image forming apparatus A forms a toner image on an image carrier (to be referred to as a "photosensitive drum"

hereinafter) 7 by irradiating the carrier with light containing an optical image based on image information from an optical system 1. A recording medium 2 is fed by feeding means 3*a* to 3*e* in synchronism with formation of the toner image, and the toner image formed on the photosensitive drum by an image forming unit integrated as the process cartridge is transferred onto the recording medium 2 by a transfer means 4. The recording medium 2 is then fed to a fixing means 5 to fix the transferred toner image. Thereafter, the recording medium 2 is exhausted onto an exhaust unit 6.

The process cartridge B constituting the image forming unit uniformly charges the surface of the photosensitive drum 7 using a charging means 8 by rotating the drum, and exposes the photosensitive drum 7 to an optical image from the optical system 1 via an exposure aperture 9, thus forming a latent image. The latent image is visualized or developed by a developing means 10 to form a toner image. After the toner image is transferred onto the recording medium 2 by the transfer means 4, the residual toner on the photosensitive drum 7 is removed by a cleaning means 11. Note that the respective parts such as the photosensitive drum 7 are housed in a resin developing frame member 12*a* and a cleaning frame member 12*b* constituting a housing 12 to constitute a cartridge.

<Image Forming Apparatus>

The arrangements of the respective portions of the image forming apparatus A will be explained below in the order of the optical system, feeding means, transfer means, fixing means, and cartridge attachment or mount means.

[Optical System]

The optical system 1 irradiates the drum 7 with light containing an optical image on the basis of image information read from an external apparatus or the like. An optical unit la of a main body 13 houses a laser diode 1*b*, a polygonal mirror 1*c*, a scanner motor 1*d*, and an imaging lens 1*e*.

For example, when an image signal is supplied from an external apparatus, such as a computer, a wordprocessor, or the like, the laser diode 1*b* emits light in correspondence with the image signal, and irradiates the polygonal mirror 1*c* as image light. The polygonal mirror 1*c* with the emitted light is rotated at a high speed by the scanner motor 1*d*, and the image light reflected by the polygonal mirror 1*c* irradiates the photosensitive drum 7 via the imaging lens 1*e* and a reflection mirror 1*f* to selectively expose the surface of the photosensitive drum 7 to the image light, thereby forming a latent image in correspondence with the image information.

[Recording Medium Feeding Means]

The feeding means for feeding the recording medium (e.g., a recording paper sheet, OHP sheet, cloth, thin plate, or the like) has a loading unit for a cassette 3*a* in the main body 13. The recording medium 2 in the loaded cassette 3*a* is picked up by a pickup roller 3*b* one by one, and the picked-up recording medium 2 is fed to a pair of registration rollers $3c_1$ and $3c_2$ via a guide plate $3e_1$. The pair of registration rollers $3c_1$ and $3c_2$ feed the recording medium 2 to an image transfer unit in synchronism with an image forming operation. The recording medium 2 on which an image has been transferred is fed to the fixing means 5 by a feeding roller $3d_1$ and a guide plate $3e_2$. After the image is fixed, the recording medium 2 is exhausted onto the exhaust unit 6 formed on the upper portion of the apparatus by a guide plate $3e_3$, exhaust rollers $3d_2$, a guide plate $3e_4$, and an exhaust roller 3*f*.

[Transfer Means]

The transfer means 4 transfers the toner image formed on the photosensitive drum 7 by the image forming unit onto the recording medium 2. The transfer means 4 of this embodiment comprises a transfer roller 4. More specifically, the recording medium 2 is pressed against the photosensitive drum 7 of the attached process cartridge B by the transfer roller 4, and a voltage having a polarity opposite to that of the toner image formed on the photosensitive drum 7 is applied to the transfer roller 4, thereby transferring the toner image on the photosensitive drum 7 onto the recording medium 2.

[Fixing Means]

The fixing means 5 fixes the toner image transferred onto the recording medium 2 upon application of a voltage to the transfer roller 4. The fixing means 5 has a driving roller 5*a* which is rotated, and a fixing roller 5*c* which includes a heater 5*b* and is driven by the driving roller 5*a* in tight contact with it. More specifically, when the recording medium 2 on which the toner image has been transferred by the image forming unit passes between the driving roller 5*a* and the fixing roller 5*c*, pressure acts on the toner image by the press contact state between the rollers 5*a* and 5*c*, and heat generated by the fixing roller 5*c* is applied to the toner image, thereby fixing the toner image on the recording medium 2 thereonto.

[Process Cartridge Mount Means]

In the image forming apparatus A, a cartridge attachment or mount means (not shown) for receiving the process cartridge B is arranged. The process cartridge B is attached/detached to/from the main body 13 by opening a cover 14. More specifically, the cover 14, which is free to open/close via a hinge 14*a*, is attached to the upper portion of the main body 13. When the cover 14 is opened, the registration rollers 3*c* and the guide plate $3e_1$ open together with the cover 14. Furthermore, a cartridge attachment space is assured in the main body 13, and right and left guide members (not shown) are arranged on the wall surfaces on the right and left sides of the cover 14. The right and left guide members have guides along which the process cartridge B is inserted. The process cartridge B is inserted along the guides, and the cover 14 is closed, thus attaching the process cartridge B to the image forming apparatus A.

<Process Cartridge>

The arrangement of the process cartridge B attached to the image forming apparatus A will be described below.

The process cartridge B comprises an electrophotographic photosensitive body and at least one process means. The process means includes, e.g., a charging means for charging the surface of the photosensitive body, a developing means for forming a toner image on the photosensitive body, and a cleaning means for cleaning residual toner on the surface of the photosensitive body. In the process cartridge B of this embodiment, the charging means 8, the exposure aperture 9, the developing means 10, and the cleaning means 11 are disposed around the photosensitive drum 7, and they are covered and integrated as a cartridge by the housing constituted by the developing frame member 12*a* and the cleaning frame member 12*b*. The cartridge can be detachably attached to the main body 13.

The arrangement of the respective portions of the process cartridge B will be described below in the order of the photosensitive drum 7, the charging means 8, the exposure aperture 9, the developing means 10, and the cleaning means 11.

[Photosensitive Drum]

The photosensitive drum 7 according to this embodiment is constituted by forming an organic photosensitive layer on the outer circumferential surface of a cylindrical aluminum drum base. The photosensitive drum 7 is rotatably attached to a frame member, and the driving force from a driving motor arranged on the main body side is transmitted to a flange gear fixed to one end, in the longitudinal direction, of the photosensitive drum 7 to rotate the photosensitive drum 7 in the direction of an arrow in FIG. 2 in accordance with the image forming operation.

[Charging Means]

The charging means is used for uniformly charging the surface of the photosensitive drum 7. This embodiment adopts a contact charging method in which a charging roller 8 is pivotally attached to the frame member. The charging roller 8 is constituted by arranging a conductive elastic layer on a metal roller shaft, arranging a high-resistance elastic layer thereon, and forming a protection film on the surface of the high-resistance elastic layer. The conductive elastic layer comprises an elastic rubber layer such as EPDM, NBR, or the like dispersed with carbon, and serves to conduct a bias voltage supplied to the roller shaft. The high-resistance elastic layer comprises, e.g., urethane rubber, and contains a very small amount of conductive fine powder. The high-resistance elastic layer serves to limit the leakage current to the photosensitive drum to prevent an abrupt bias voltage drop even when the charging roller opposes a portion with a high conductivity such as a pinhole on the photosensitive drum 7. The protection layer comprises N-methoxymethyl nylon, and serves to prevent the composition materials of the conductive elastic layer and the high-resistance elastic layer from contacting and denaturing the surface of the photosensitive drum 7.

The charging roller 8 is in contact with the photosensitive drum 7, and is driven by the photosensitive drum 7 upon image formation. At this time, when superposed DC and AC currents are applied to the charging roller 8, the surface of the photosensitive drum 7 is uniformly charged.

[Exposure Aperture]

The exposure aperture 9 is used for exposing the surface, uniformly charged by the charging roller 8, of the photosensitive drum 7 to an optical image irradiated by the optical system 1 so as to form an electrostatic latent image on the surface of the photosensitive drum 7. The exposure aperture 9 is formed on the upper surface of the cartridge frame member.

[Developing Means]

The developing means stores toner in the developing frame member 12a as a developing container for storing toner. In the opening portion of the developing frame member **12*a*, a developing roller 10*a*, which has a non-rotatable magnet therein and forms a thin toner layer on its surface upon rotation, is arranged to have a very small gap from the photosensitive drum 7**.

The developing roller **10*a* is constituted by roughening the surface of an aluminum cylindrical member by, e.g., a sandblast treatment and coating it with a conductive paint dispersed with a pigment. When a toner layer is formed on the surface of the developing roller 10*a*, a charge of triboelectrification high enough to develop an electrostatic latent image on the photosensitive drum 7 is generated by friction between the toner and the developing roller 10*a*. Also, the developing means 10 comprises a developing blade 10*b*** for regulating the thickness of the toner layer.

[Cleaning Means]

The cleaning means 11 is constituted by a cleaning blade **11*a* which contacts the surface of the photosensitive drum 7 and scrapes off the residual toner on the photosensitive drum 7, a dip sheet 11*b* which is located above the cleaning blade 11*a* so as not to scatter the scraped toner, and is in light contact with the surface of the photosensitive drum 7, and a waste toner storage 11*c*** for storing dipped waste toner.

Figure 1:
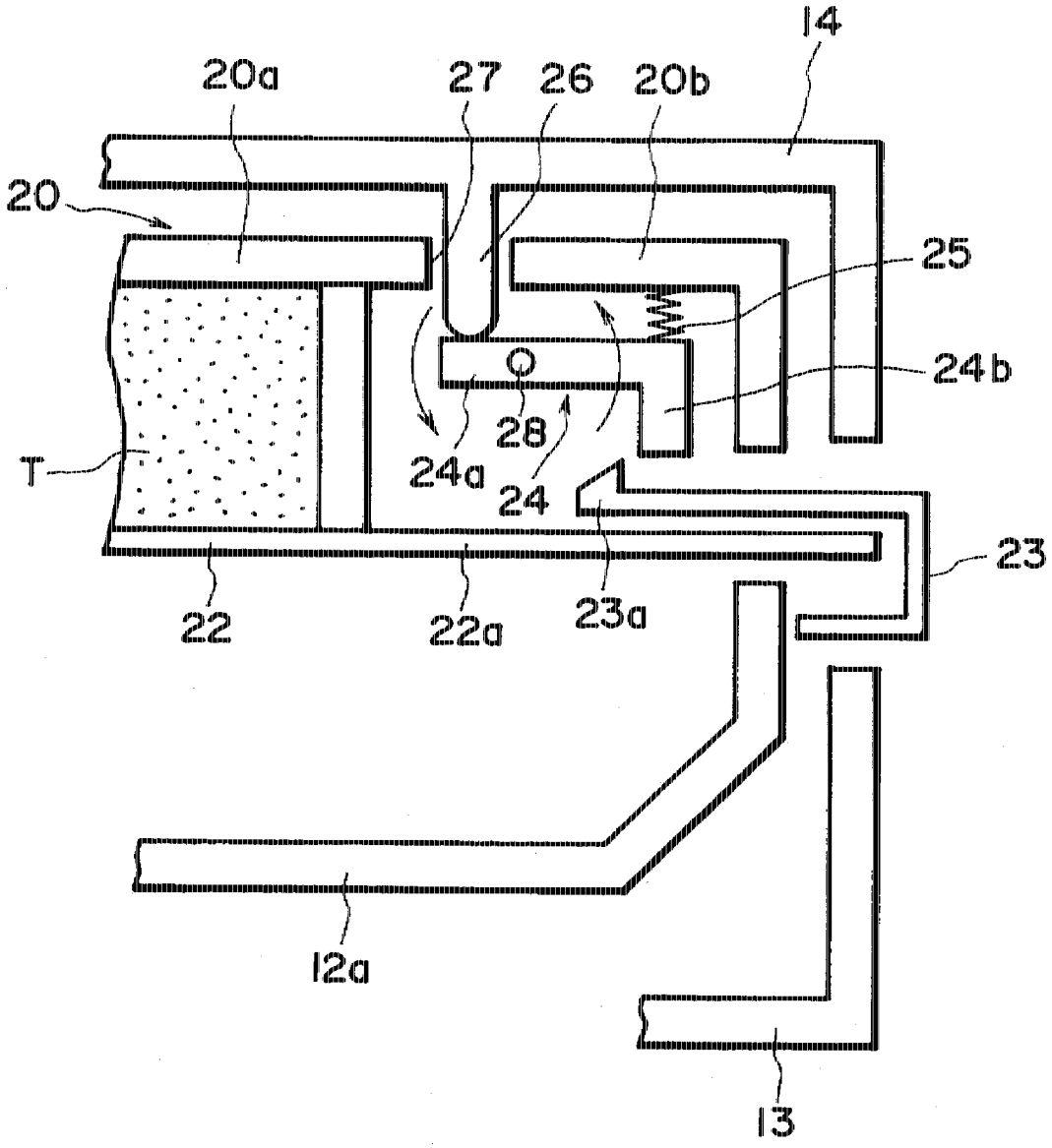
FIG. 1 is an explanatory view showing the characteristic feature portion of a first embodiment according to the present invention.

The characteristic feature portion of the embodiment of the present invention will be described below with reference especially to FIG. 1. A developing agent supply container 20 which stores toner T is detachably attached to the upper portion of the developing frame member **12*a* of the process cartridge B via the cleaning frame member 12*b*, and an opening portion 21, as an exhaust portion of toner formed on the lower portion of the container 20, is sealed by a seal member 22. The seal member 22 has a grip portion 22*a* extending in the horizontal direction. The grip portion 22*a* is covered by a cover member 23, so that it cannot be directly touched before the process cartridge B is attached to the image forming apparatus main body 13**.

The arrangement of the container 20 will be described in more detail below. The cover member 23 is formed with a pawl member **23*a* on its toner storage portion 20*a* side, and the pawl member 23*a* is locked by an arm 24 as a lock member. More specifically, the arm 24 has an L-shaped section, and a spring member 25 is inserted between one end of a long piece 24*a* of the arm 24 and an extended portion 20*b* of the toner storage portion 20*a*, and a short piece 24*b* of the arm 24 is locked by the pawl portion 23*a* of the cover member 23 by the biasing force of the spring member 25. With this structure, the cover member 23 can be prevented from disengaging from the grip portion 22*a*** of the seal member due to, e.g., a vibration.

A projection 26 is formed to extend inward on the cover 14 of the main body. The projection 26 is set to have a length large enough to extend through a hole 27 formed on the extended portion **20*b* of the toner storage portion 20*a* and press the long piece 24*a* of the arm 24** downward.

With the above arrangement, after the cover 14 is opened, and the process cartridge B is attached to the main body 13 of the image forming apparatus, when the cover 14 is closed, the projection 26 of the cover 14 extends through the hole 27, and presses the long piece **24*a* of the arm 24. Then, as shown in FIG. 1, the arm 24 pivots counterclockwise (indicated by an arrow in FIG. 1) about a shaft 28 as a fulcrum against the biasing force of the spring member 25, and the short piece 24*b* of the arm 24 is unlocked from the pawl portion 23*a* of the cover member 23**.

As a result, the cover member 23 can be detached, and the grip portion **22*a* of the seal member 22 is exposed outside the main body 13. By pulling the grip portion 22*a*, the seal member 19 can be peeled from the toner storage portion 20*a***, and the toner T stored therein can be supplied to a developing container.

Figure 3:
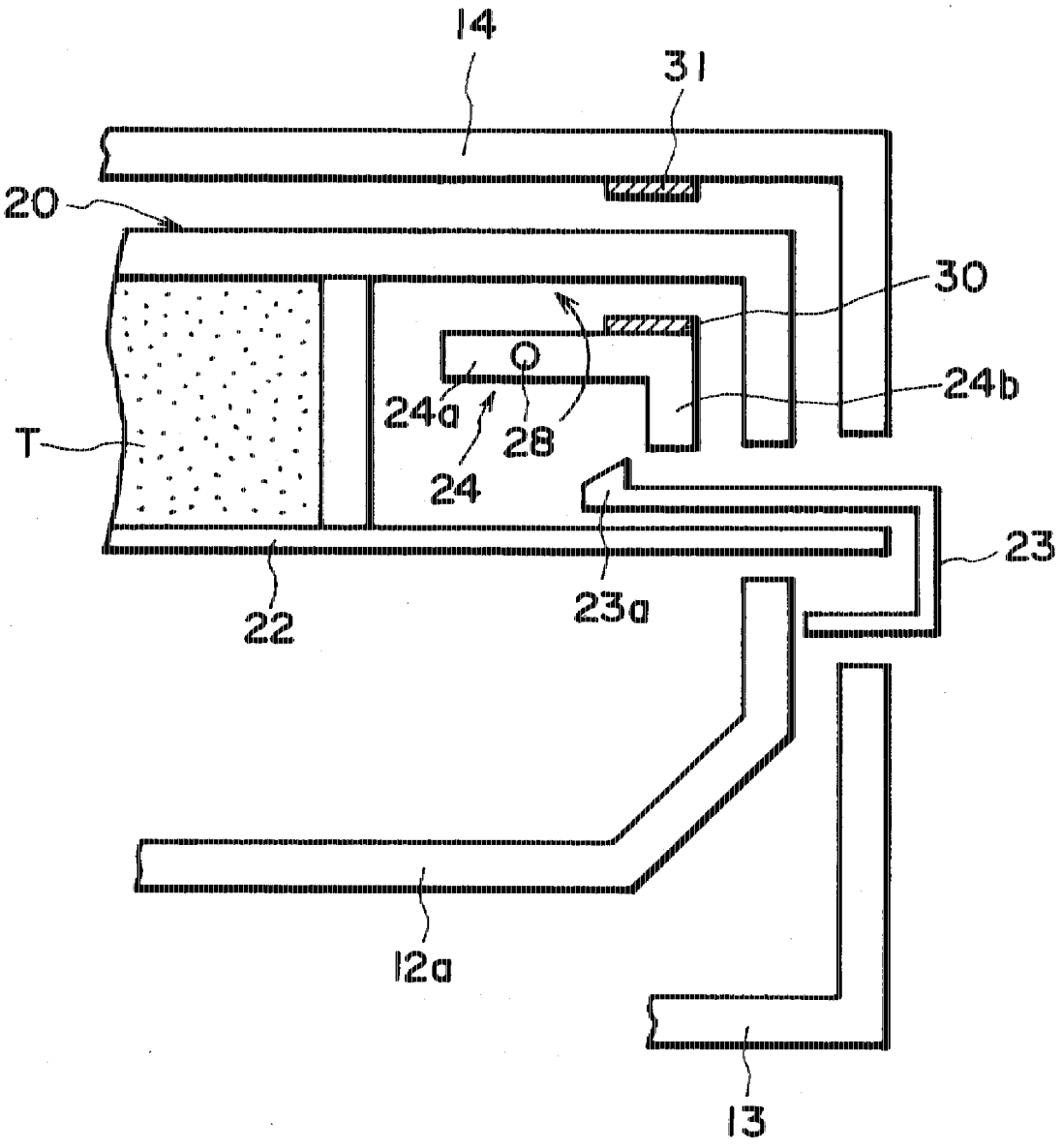
FIG. 3 is an explanatory view showing a first modification of the first embodiment.

Note that a magnet 30 may be arranged on the arm 24 in place of the spring member 25 of this embodiment, as shown in FIG. 3, and a magnet 31 having a magnetic pole opposite to that of the magnet 30 may be arranged at the corresponding position of the inner surface of the cover 14. Alternatively, one of the magnets 30 and 31 may comprises a non-magnetic member. In this case, the projection 26 of the cover 14 and the hole 27 in this embodiment can be omitted.

In this arrangement, after the process cartridge B is attached to the main body 13 of image forming apparatus, when the cover 14 is closed, since the magnets 30 and 31 have different magnetic poles and magnetically attract with each other, the arm 24 pivots counterclockwise, as indicated by an arrow in FIG. 3. Thus, the arm 24 is unlocked from the pawl portion **23*a* of the cover member 23, and the cover member 23** can be detached.

Figure 4:
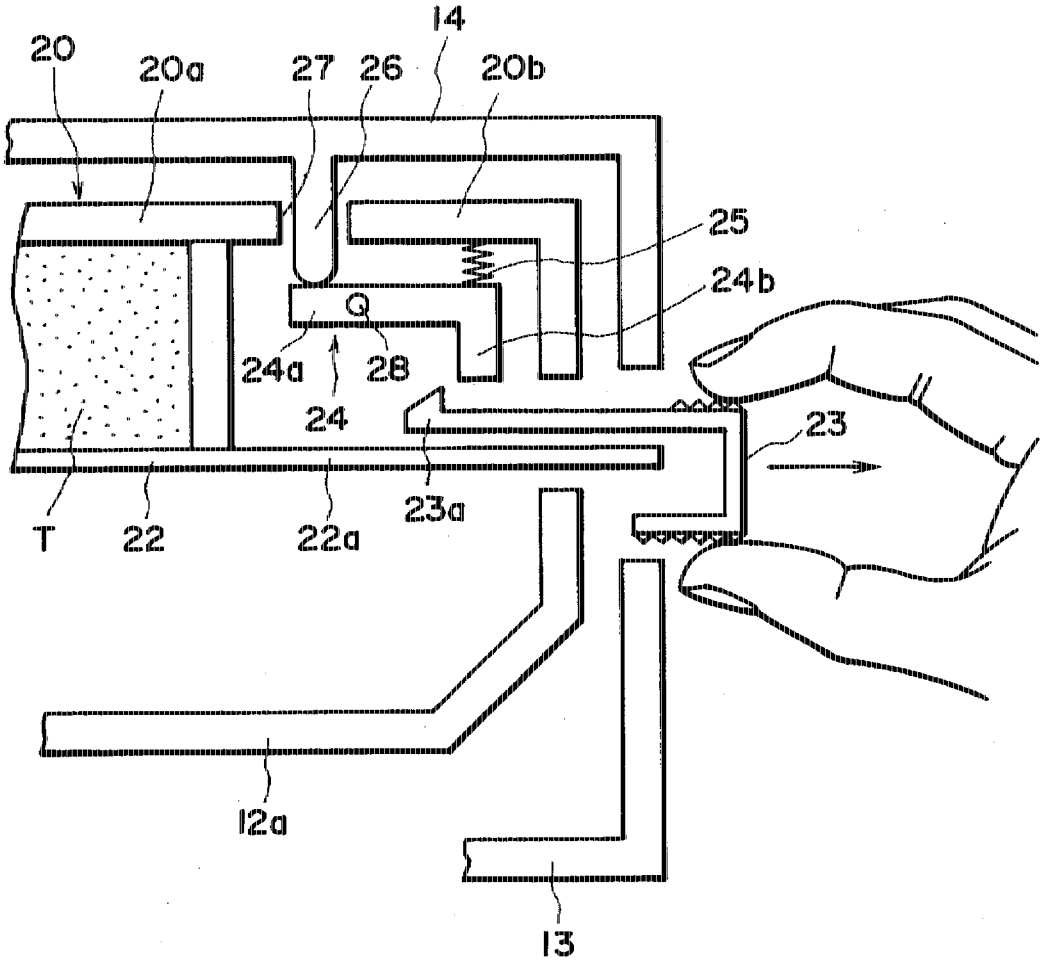
FIG. 4 is an explanatory view showing a second modification of the first embodiment.

On the other hand, as shown in FIG. 4, the cover member 23 and the grip portion **22*a* of the seal member 22** may be integrally coupled in substantially the same arrangement as that of the above embodiment. With this arrangement, the cover member 23 can be used as a grip to be held when the seal member 22 is removed, thus improving operability. As described above, the seal member cannot be peeled unless the process cartridge is attached to the main body. In other words, toner can be supplied only when the process cartridge is attached to the main body. Therefore, scattering or moisture absorption of toner during the manufacturing process or transportation can prevented.

Figure 5:
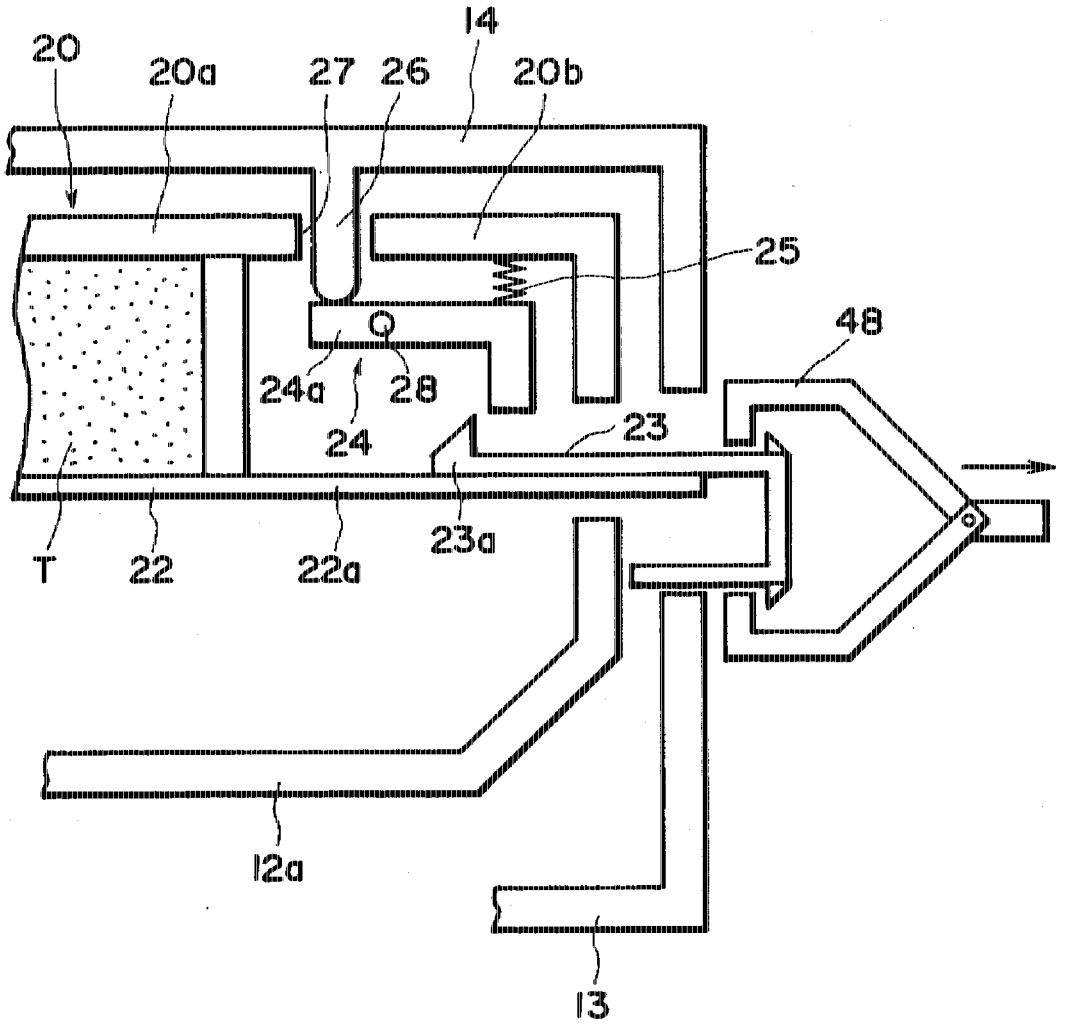
FIG. 5 is an explanatory view showing the third modification of the first embodiment.

Note that, as shown in FIG. 5, a detachment member 48 as a lever may be coupled to the cover member 23, and may be operated by an operation means (not shown) arranged on the main body, thus preventing an operation error more effectively.

In this embodiment, the developing agent supply container is detachably attached to the process cartridge, and the process cartridge is attached to the main body. Alternatively, the present invention may be applied to a case wherein the developing agent container is directly attached to the main body.

Second Embodiment

Figure 6:
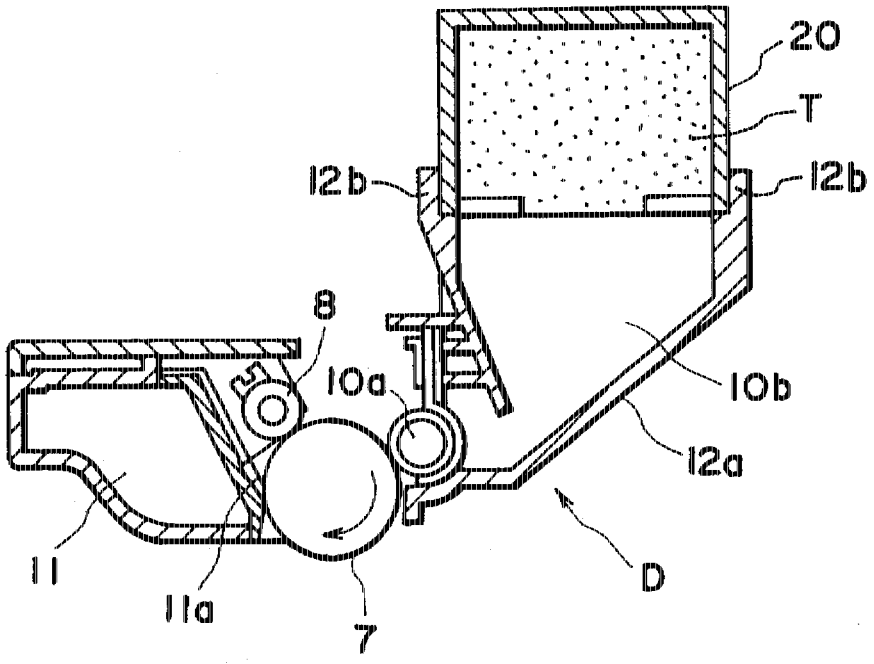
FIG. 6 is an explanatory view showing a developing device of a second embodiment according to the present invention.

FIG. 6 shows a developing device D which is constituted as a cartridge according to another embodiment of the present invention.

In the developing device D of this embodiment, a developing means to which a developing agent carrier 10*a*, such as a developing sleeve and a developing agent supply container 20 which stores toner T to be supplied to the developing agent carrier 10*a*, are attached is integrated as a cartridge via a plastic frame member 12*a*. More specifically, the developing device D of this embodiment can be considered as a cartridge which is integrated by excluding the photosensitive drum 7, the charging means 8, and the cleaning means 11 from the process cartridge B described in the first embodiment. Therefore, the arrangement and operation of the developing agent supply container 20 are the same as those in the first embodiment, the same reference numerals denote parts having the same arrangements and operations as those in the first embodiment, and the above description will be quoted therefor.

Third Embodiment

The third embodiment according to the present invention will be described below with reference to FIGS. 7 to 10.

Figure 7:
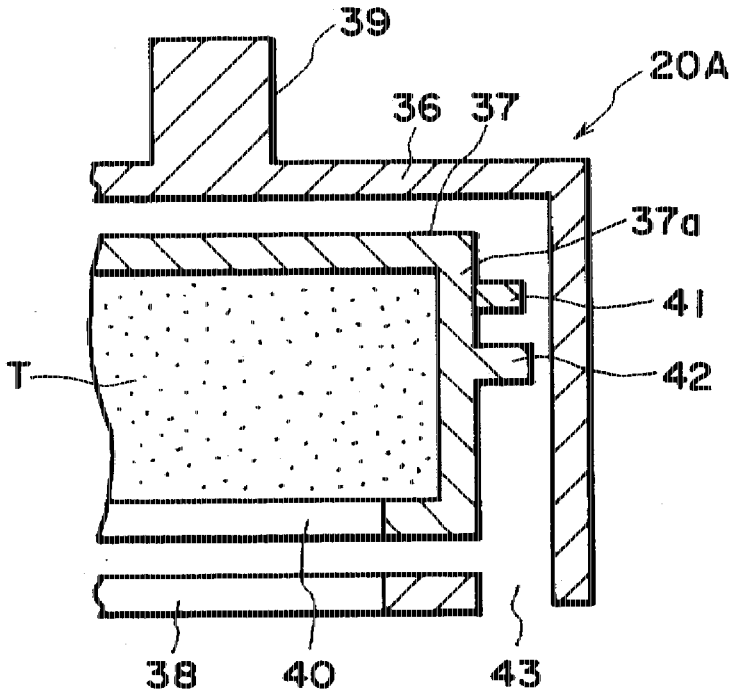
FIG. 7 is an explanatory view showing a developing container as the characteristic feature portion of the second embodiment according to the present invention.
Figure 8:
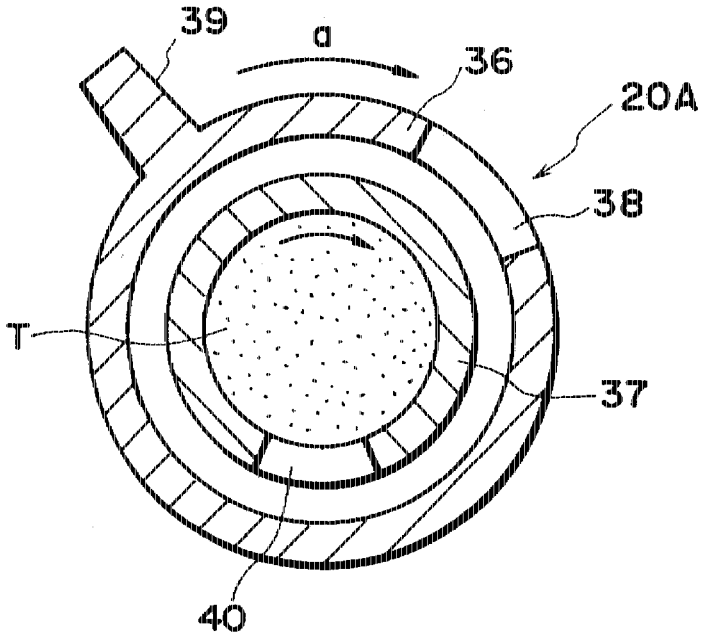
FIG. 8 is a sectional view for explaining the developing container shown in FIG. 7.

In this embodiment, a developing agent supply container 20A has a double cylinder structure including an outer cylinder 36 and an inner cylinder 37 fitted in the outer cylinder 36, as shown in FIGS. 7 and 8. The outer cylinder 36 is formed with a large opening portion 38 extending along its longitudinal direction, and is provided with a rotary lever 39, which projects outwardly, on its outer circumferential surface. The inner cylinder 37 is formed with an opening portion 40 similar to the opening portion 38 of the outer cylinder 36, and a stopper 41 and a support shaft 42, which project outwardly, are formed on one vertical end portion 37*a* of the cylinder 37.

The inner cylinder 37 stores toner T therein. As shown in FIG. 8, when the opening portion 38 of the outer cylinder 36 and the opening portion 40 of the inner cylinder 37 are rotated to a non-overlapping position, i.e., in a case other than a case wherein the developing agent supply container 20A is attached to the main body, the positional relationship between the outer and inner cylinders 36 and 37 is determined, so that the toner T is held in the inner cylinder 37 and never flows out to an external portion. In this state, even when the rotary lever 39 of the outer cylinder 36 is rotated in the direction of an arrow a, the outer and inner cylinders 36 and 37 rotate together due to the frictional force acting between themselves, and the toner T can be prevented from leaking externally.

Note that a guide hole 43 used for guiding a support member, which is arranged on the main body to support the support shaft 42 of the inner cylinder 37, is formed on the outer cylinder 36, as shown in FIG. 7. The guide hole 43 is set to have a small width, so that the user may not accidentally insert his or her finger into this hole in terms of safety.

Figure 9:
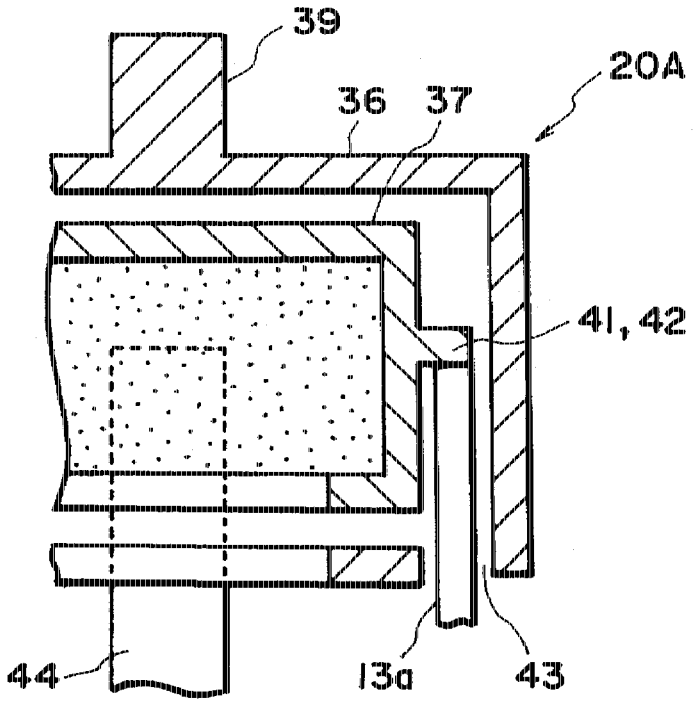
FIG. 9 is an explanatory view showing a state wherein the developing container shown in FIG. 7 is attached to an apparatus main body.
Figure 10:
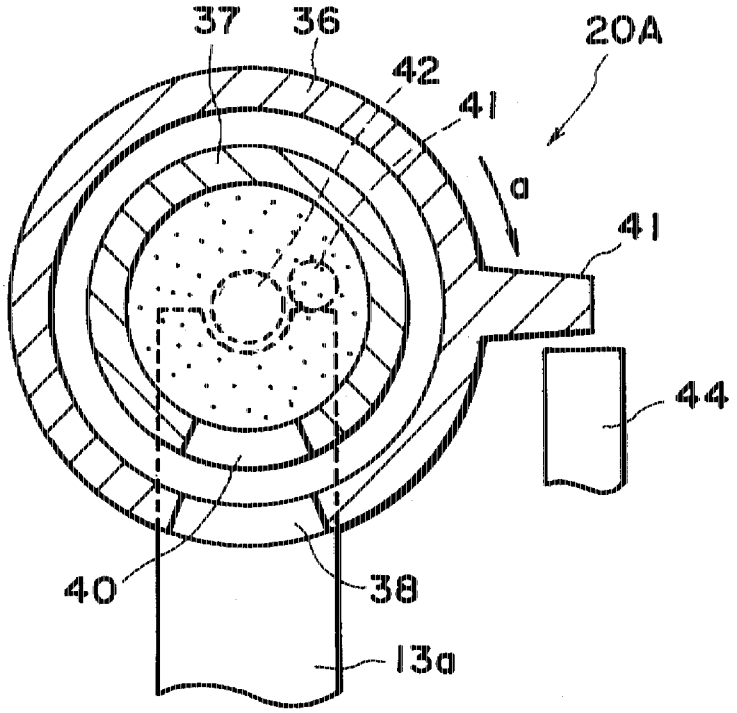
FIG. 10 is an explanatory view showing a state wherein toner in the developing container shown in FIG. 7 is supplied.

A case will be explained below with reference to FIGS. 9 and 10 wherein the developing agent supply container 20A is attached to the main body. When the developing agent supply container 20A is attached to the main body, a support member 13*a* arranged on the main body engages the support shaft 42 of the inner cylinder 37 via the guide hole 43 of the outer cylinder 36.

When the rotary lever 39 of the outer cylinder 36 is rotated in the direction of the arrow a, the outer and inner cylinders 36 and 37 initially rotate together, but when the lever 39 is further rotated, the rotation stopper 41 of the inner cylinder 37 contacts the support member 13a as a first abutting member of the main body, and the inner cylinder 37 cannot rotate any more.

When the rotary lever 39 of the outer cylinder 36 is further rotated against the frictional force between the outer and inner cylinders 36 and 37, the rotary lever 39 abuts against a lever stopper 44 as a second abutting member of the main body, and stops its rotation. At this time, the opening portion 40 of the inner cylinder 37 overlaps the opening portion 38 of the outer cylinder 36, and the toner T is ready to be supplied to the developing means.

With the above-mentioned arrangement, only when the developing agent supply container is attached to the main body, toner can be supplied to the developing means. Therefore, scattering or moisture absorption of toner during the manufacturing process or transportation can prevented.

Figure 11:
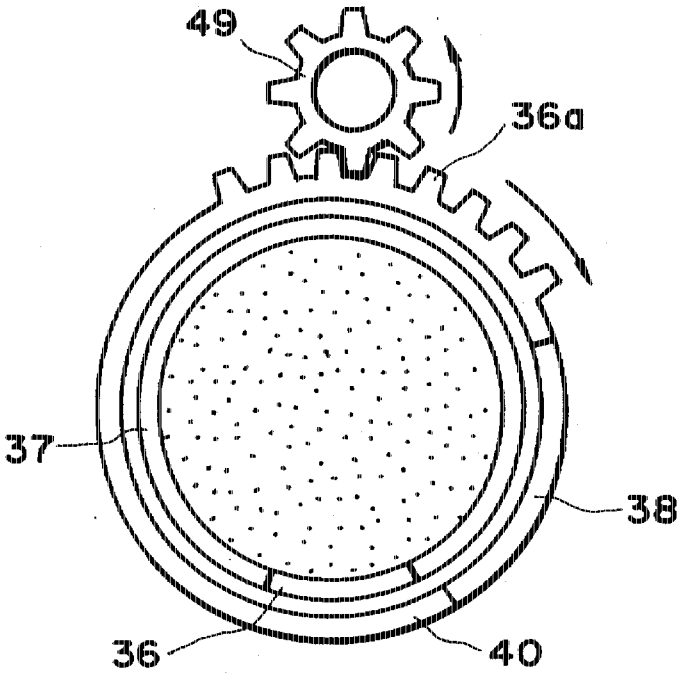
FIG. 11 is an explanatory view showing a modification of the second embodiment.

In the above description, the rotary lever is manually rotated while the developing agent supply container is attached to the main body of image forming apparatus. Alternatively, as shown in FIG. 11, a gear 36*a* may be formed on a portion of the outer cylinder 36, and a driving gear 49 meshing with this gear 36*a* may be arranged and may be driven by a driving means or the like arranged on the main body. This arrangement can more effectively prevent an operation error.

In this embodiment, the developing agent supply container is directly attached to the main body. Also, the present invention may be applied to a case wherein the developing agent supply container is attached to a process cartridge which, in turn, is attached to the main body.

The characteristic feature portion of the present invention described in this embodiment can be applied to the developing device described in the second embodiment, as a matter of course, and a detailed description thereof will be omitted.

According to the above-mentioned embodiments, a developing agent supply container which cannot exhaust a developing agent by itself outside the container, and can supply the developing agent only when it is attached to a developing agent storage portion, can be provided.

According to the above-mentioned embodiments, only when the developing agent supply container is attached to a process cartridge, a developing device, or a main body of image forming apparatus, the developing agent in the developing agent supply container can be supplied. Therefore, a process cartridge, a developing device and a developing agent supply container, and a main body of image forming apparatus using these process cartridge, developing device, and developing agent supply container, which can prevent scattering of a developing agent and an operation error, can be provided.

As described above, according to the present invention, when the container is attached to a predetermined position, a developing agent can be supplied.

What is claimed is:

1. A developing agent supply container for supplying a developing agent to a developing agent storage container for storing the developing agent to be used for developing a latent image formed on an electrophotographic photosensitive body, said developing agent storage container being provided in a main body of an image forming apparatus having an open/close member openable to mount said developing agent supply container onto said developing agent storage container, said developing agent supply container comprising:

a developing agent storage portion; and inhibition means for inhibiting supply of the developing agent stored in said developing agent storage portion to said developing agent storage container when said developing agent supply container is removed from a predetermined position of said developing agent storage container, said inhibition means permitting supply of the developing agent stored in said developing agent storage portion to said developing agent storage container when said developing agent supply container is mounted to the predetermined position of said developing agent storage container, and said open/close member is closed.

2. A supply container according to claim 1, wherein said developing agent supply container further comprises a supply opening for supplying the developing agent stored in said developing agent storage portion to the developing agent storage container, and a seal for openably sealing said supply opening, said inhibition means having a cover member covering a distal end of said seal to inhibit said seal from being pulled out for opening said supply opening, and wherein said cover member is rendered removable upon unlocking of a locked portion thereof by closing an open/close cover provided in the main body of the image forming apparatus, when said developing agent supply container is mounted onto said developing agent storage container, a said seal being rendered pullable by removal of said cover member.

3. A supply container according to claim 2, wherein the locked portion is a pawl-shaped portion provided to said cover member, the pawl-shaped portion being locked by an arm biased by a spring, and when the open/close cover is closed, the arm is rotated while being pushed by the open/close cover, and is unlocked from the pawl-shaped portion, thereby allowing removal of said cover member.

4. A supply container according to claim 1, wherein said developing agent storage portion is an inner cylinder and comprises an outer cylinder outside said inner cylinder, wherein said inner and outer cylinders have supply openings and can supply the developing agent stored in said developing agent supply portion when the two supply openings oppose each other, said inhibition means comprises a rotation stopper provided to said inner cylinder, wherein the rotation of the rotation stopper is inhibited by abutting against an abutting portion provided to a main body of said image forming apparatus when said developing agent supply container is mounted to a process cartridge and said inner cylinder is rotated, and by rotating said outer cylinder, the two supply openings oppose each other to supply the developing agent stored in said developing agent storage portion to the developing agent storage container.

5. A process cartridge which is removably mounted to a main body of an electrophotographic image forming apparatus, comprising:

a. an electrophotographic photosensitive body;

b. process means for performing an operation on said electrophotographic photosensitive body;

c. a developing agent storage container for storing a developing agent to be used for developing a latent image formed on said electrophotographic photosensitive body, said developing agent storage container being provided in the main body of the electrophotographic image forming apparatus wherein said process cartridge is mounted in the main body of the electrophotographic image forming apparatus, the electrophotographic image forming apparatus having an open/close member openable to mount a developing agent supply container onto said developing agent storage container; and d. a container mount portion to which the developing agent supply container is removably mounted, which developing agent supply container comprises:

a developing agent storage portion, and inhibition means for inhibiting supply of the developing agent stored in the developing agent storage portion to the developing agent storage container when said developing agent supply container is removed from a predetermined position of said developing agent storage container, said inhibition means also permitting supply of the developing agent stored in the developing agent storage portion to the developing agent storage container when the developing agent supply container is mounted to the predetermined position of said developing agent storage container, and said open/close member is closed.

6. A process cartridge according to claim 5, wherein the developing agent supply container further comprises a supply opening for supplying the developing agent stored in said developing agent storage portion to the developing agent storage container, and a seal for openably sealing said supply opening, said inhibition means having a cover member covering a distal end of said seal to inhibit said seal from being pulled out for opening said supply opening, and said cover member is rendered removable upon unlocking of a locked portion thereof by closing the open/close cover provided in the main body of said electrophotographic image forming apparatus, when said developing agent supply container is mounted onto said developing agent storage container, said seal being rendered pullable by removal of said cover member.

7. A process cartridge according to claim 6, wherein the locked portion is a pawl-shaped portion provided to said cover member, the pawl-shaped portion being locked by an arm biased by a spring, and when the open/close cover is closed, the arm is rotated while being pushed by the open/close cover, and is unlocked from the pawl-shaped portion, thereby allowing removal of said cover member.

8. A process cartridge according to claim 5, wherein said developing agent storage portion is an inner cylinder and comprises an outer cylinder outside said inner cylinder, wherein said inner and outer cylinders have supply openings and can supply the developing agent stored in said developing agent supply portion when the two supply openings oppose each other, wherein said inhibition means comprises a rotation stopper provided to said inner cylinder, wherein the rotation of the rotation stopper is inhibited by abutting against an abutting portion provided to the main body of said image forming apparatus when said developing agent supply container is mounted to said process cartridge and said inner cylinder is rotated, and by rotating said outer cylinder, the two supply openings oppose each other to supply the developing agent stored in said developing agent storage portion to the developing agent storage container.

9. A process cartridge according to claim 5, wherein said process cartridge is constituted by integrating, as a cartridge, at least one of charging means, developing means, and cleaning means as said process means with said electrophotographic photosensitive body, and the cartridge is removably mounted to the main body of the electrophotographic image forming apparatus.

10. A process cartridge according to claim 5, wherein said process cartridge is constituted by integrating, as a cartridge, charging means, and one of developing means and cleaning means as said process means with said electrophotographic photosensitive body, and the cartridge is removably mounted to the main body of the electrophotographic image forming apparatus.

11. A process cartridge according to claim 5, wherein said process cartridge is constituted by integrating, as a cartridge, developing means as said process means with said electrophotographic photosensitive body, and the cartridge is removably mounted to the main body of the electrophotographic image forming apparatus.

12. A process cartridge which is removably mounted to a main body of an electrophotographic image forming apparatus, comprising:

a. an electrophotographic photosensitive drum;

b. a developing roller for developing a latent image formed on said electrophotographic photosensitive drum;

c. a charging member for charging said electrophotographic photosensitive drum;

d. a cleaning blade for removing a residual developing agent remaining on said electrophotographic photosensitive drum;

e. a developing agent storage container for storing a developing agent to be used for developing the latent image formed on said electrophotographic photosensitive drum by said developing roller, the developing agent storage container being provided in the main body of the electrophotographic image forming apparatus when the process cartridge is mounted in the main body of the electrophotographic image forming apparatus, the electrophotographic image forming apparatus having an open/close member openable to mount a developing agent supply container onto said developing agent storage container; and f. a container mount portion to which the developing agent supply container is removably mounted, which developing agent supply container comprises:

a developing agent storage portion, and inhibition means for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed.

13. A process cartridge according to claim 12, wherein said developing agent supply container further comprises a supply opening for supplying the developing agent stored in said developing agent storage portion to the developing agent storage container, and a seal for openably sealing said supply opening, said inhibition means having a cover member covering a distal end of said seal to inhibit said seal from being pulled for opening said supply opening, and wherein said cover member is rendered removable upon unlocking of a locked portion thereof by closing the open/close cover provided in the main body of the electrophotographic image forming apparatus when said developing agent supply container is mounted onto said developing agent storage container, said seal being rendered pullable by removal of said cover member.

14. A process cartridge according to claim 13, wherein the locked portion is a pawl-shaped portion provided to said cover member, the pawl-shaped portion being locked by an arm biased by a spring, and when the cover is open/close closed, the arm is rotated while being pushed by the open/close cover, and is unlocked from the pawl-shaped portion, thereby allowing removal of said cover member.

15. A process cartridge according to claim 12, wherein said developing agent storage portion is an inner cylinder and comprises an outer cylinder outside said inner cylinder, wherein said inner and outer cylinders have supply openings and can supply the developing agent stored in said developing agent supply portion when the two supply openings oppose each other, wherein said inhibition means comprises a rotation stopper provided to said inner cylinder, wherein the rotation of the rotation stopper is inhibited by abutting against an abutting portion provided to a main body of said image forming apparatus when said developing agent supply container is mounted to a process cartridge and said inner cylinder is rotated, and by rotating said outer cylinder, the two supply openings oppose each other to supply the developing agent stored in said developing agent storage portion to the developing agent storage container.

16. An electrophotographic image forming apparatus to which a process cartridge is removably mounted, and which forms an image on a recording medium, comprising:

a. a mount portion for mounting the process cartridge removably mounted, said mount portion comprising:

an electrophotographic photosensitive body, process means for performing an operation on said electrophotographic photosensitive body, an open/close member openable to mount a developing agent supply container onto a developing agent storage container, a developing agent storage container for storing a developing agent to be used for developing a latent image formed on said electrophotographic photosensitive body, said developing agent storage container being provided in a main body of said image forming apparatus, and a container mount portion to which the developing agent supply container is removably mounted, the developing agent supply container comprising a developing agent storage portion, and inhibition means for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed; and b. feeding means for feeding the recording medium.

17. An electrophotographic image forming apparatus to which a process cartridge is removably mounted, and which forms an image on a recording medium, comprising:

a. a mount portion to which the process cartridge is removably mounted, said mount portion comprising:

an electrophotographic photosensitive drum, a developing roller for developing a latent image formed on said electrophotographic photosensitive drum, a charging member for charging said electrophotographic photosensitive drum, a cleaning blade for removing a residual developing agent remaining on said electrophotographic photosensitive drum, a developing agent storage container for storing a developing agent to be used for developing the latent image formed on said electrophotographic photosensitive drum by said developing roller and being provided in a main body of said image forming apparatus, an open/close member openable to mount a developing agent supply container onto said developing agent storing container, and a container mount portion to which the developing agent supply container is removably mounted, said developing agent supply container comprising a developing agent storage portion, and inhibition means for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed; and b. feeding means for feeding the recording medium.

18. A developing agent supply container for supplying a developing agent to a developing agent storage container for storing the developing agent to be used for developing a latent image formed on an electrophotographic photosensitive body, said developing agent storage container being provided in a main body of an image forming apparatus having an open/close member openable to mount said developing agent supply container onto said developing agent storage container, said developing agent supply container comprising:

a developing agent storage portion;

a supply opening for supplying a developing agent stored in said developing agent storage portion to the developing agent storage container;

a seal for openably sealing said supply opening; and an inhibition member for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed, said inhibition member comprising a cover member covering a distal end of said seal to inhibit said seal from being pulled out for opening said supply opening, and said cover member being rendered removable upon unlocking of a locked portion thereof by closing an open/close cover provided in the main body of said image forming apparatus, when said developing agent supply container is mounted onto said developing agent storage container, said seal being rendered pullable by removal of said cover member.

19. A container supply according to claim 18, wherein the locked portion is a pawl-shaped portion provided to said cover member, the pawl-shaped portion being locked by an arm biased by a spring, and when the open/close cover is closed, the arm is rotated while being pushed by the open/close cover, and is unlocked from the pawl-shaped portion, thereby allowing removal of said cover member.

20. A process cartridge which is removably mounted to a main body of an electrophotographic image forming apparatus, comprising:

a. an electrophotographic photosensitive body;

b. process means for performing an operation on said electrophotographic photosensitive body;

c. a developing agent storage container for storing a developing agent to be used for developing a latent image formed on said electrophotographic photosensitive body, said developing agent storage container being provided in a main body of the electrophotographic image forming apparatus when the process cartridge is mounted in the main body of the electrophotographic image forming apparatus, the electrophotographic image forming apparatus having an open/close member openable to mount a developing agent supply container onto said developing agent storage container; and d. a container mount portion to which a developing agent supply container is removably mounted, which developing agent supply container comprises:

a developing agent storage portion, a supply opening for supplying a developing agent stored in said developing agent storage portion to the developing agent storage container, a seal for openably sealing said supply opening, and an inhibition member for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed, said inhibition member comprising a cover member covering a distal end of said seal to inhibit said seal from being pulled out for opening said supply opening, and said cover member being rendered removable upon unlocking of a locked portion thereof by closing an open/close cover provided in the main body of the image forming apparatus, when said developing agent supply container is mounted onto said developing agent storage container, said seal being rendered pullable by removal of said cover member.

21. A process cartridge according to claim 20, wherein said process cartridge is constituted by integrating, as a cartridge, at least one of charging means, developing means, and cleaning means as said process means with said electrophotographic photosensitive body, and the cartridge is removably mounted to the main body of the electrophotographic image forming apparatus.

22. A process cartridge according to claim 20, wherein said process cartridge is constituted by integrating, as a cartridge, charging means, and one of developing means and cleaning means as said process means with said electrophotographic photosensitive body, and the cartridge is removably mounted to the main body of the electrophotographic image forming apparatus.

23. A process cartridge according to claim 20, wherein said process cartridge is constituted by integrating, as a cartridge, developing means as said process means with said electrophotographic photosensitive body, and the cartridge is removably mounted to the main body of the electrophotographic image forming apparatus.

24. An electrophotographic image forming apparatus to which a process cartridge is removably mounted, and which forms an image on a recording medium, comprising:

a. a mount portion to which the process cartridge is removably mounted, said mount portion comprising:

an electrophotographic photosensitive body, process means for performing an operation on said electrophotographic photosensitive body, a developing agent storage container for storing a developing agent to be used for developing a latent image formed on said electrophotographic photosensitive body, said developing agent storage container being provided in a main body of the electrophotographic image forming apparatus, an open/close member openable to mount a developing agent supply container onto said developing agent storage container, and a container mount portion to which the developing agent supply container is removably mounted, said developing agent supply container comprising a developing agent storage portion, a supply opening for supplying a developing agent stored in said developing agent storage portion to the developing agent storage container, a seal for openably sealing said supply opening, and an inhibition member for inhibiting supply of the developing agent stored in said developing agent storage portion to said developing agent storage container when said developing agent supply container is removed from a predetermined position of said developing agent storage container, said inhibition means also permitting supply of the developing agent stored in said developing agent storage portion to said developing agent storage container when said developing agent supply container is mounted at the predetermined position of said developing agent storage container, and said open/close member is closed, said inhibition member having a cover member covering a distal end of said seal to inhibit said seal from being pulled out for opening said supply opening, and said cover member being rendered removable upon unlocking of a locked portion thereof by closing an open/close cover provided in the main body of the image forming apparatus, when said developing agent supply container is mounted onto said developing agent storage container, said seal being rendered pullable by removal of said cover member; and b. feeding means for feeding the recording medium.

25. A developing agent supply container for supplying a developing agent to a developing agent storage container for storing the developing agent to be used for developing a latent image formed on an electrophotographic photosensitive body, said developing agent storage container being provided in a main body of an image forming apparatus having an open/close member openable to mount said developing agent supply container onto said developing agent storage container, said developing agent supply container comprising:

an inner cylinder for storing a developing agent, and having a supply opening, an outer cylinder which is arranged outside said inner cylinder and has a supply opening, the developing agent stored in said inner cylinder being able to be supplied to the developing agent storage container when the two supply openings oppose each other; and an inhibition member for inhibiting supply of the developing agent stored in said inner cylinder to said developing agent storage container when said developing agent supply container is removed from a predetermined position of said developing agent storage container, said inhibition member also permitting supply of the developing agent stored in said inner cylinder to said developing agent storage container when said developing agent supply container is mounted at the predetermined position of said developing agent storage container, and said open/close member is closed, said inhibition member comprising a rotation stopper provided to said inner cylinder, the rotation of the rotation stopper being inhibited by abutting against an abutting portion provided to a main body of the image forming apparatus when said developing agent supply container is mounted to a process cartridge and said inner cylinder is rotated, and by rotating said outer cylinder, the two supply openings opposing each other to supply the developing agent stored in said inner cylinder to the developing agent storage container.

26. A process cartridge which is removably mounted to a main body of an electrophotographic image forming apparatus, comprising:

a. an electrophotographic photosensitive body;

b. process means for performing an operation on said electrophotographic photosensitive body;

c. a developing agent storage container for storing a developing agent to be used for developing a latent image formed on said electrophotographic photosensitive body, said developing agent storage container being provided in a main body of the image forming apparatus having an open/close member openable to mount a developing agent supply container onto said developing agent storage container; and d. a container mount portion to which the developing agent supply container is removably mounted, which developing agent supply container comprises:

an inner cylinder for storing a developing agent, and having a supply opening, an outer cylinder which is arranged outside said inner cylinder and has a supply opening, the developing agent stored in said inner cylinder being able to be supplied to the developing agent storage container when the two supply openings oppose each other, and an inhibition member for inhibiting supply of the developing agent stored in said inner cylinder to said developing agent storage container when said developing agent supply container is removed from a predetermined position of said developing agent storage container, said inhibition member also permitting supply of the developing agent stored in said inner cylinder to said developing agent storage container when said developing agent supply container is mounted at the predetermined position of said developing agent storage container, and said open/close member is closed, said inhibition member comprising a rotation stopper provided to said inner cylinder, the rotation of the rotation stopper being inhibited by abutting against an abutting portion provided to a main body of the image forming apparatus when said developing agent supply container is mounted onto said developing agent storage container, and said inner cylinder is rotated, and by rotating said outer cylinder, the two supply openings opposing each other to supply the developing agent stored in said inner cylinder to the developing agent storage container.

27. A process cartridge according to claim 26, wherein said process cartridge is constituted by integrating, as a cartridge, at least one of charging means, developing means, and cleaning means as said process means with said electrophotographic photosensitive body, and the cartridge is removably mounted to the main body of the electrophotographic image forming apparatus.

28. A process cartridge according to claim 26, wherein said process cartridge is constituted by integrating, as a cartridge, charging means, and one of developing means and cleaning means as said process means with said electrophotographic photosensitive body, and the cartridge is removably mounted to the main body of the electrophotographic image forming apparatus.

29. A process cartridge according to claim 26, wherein said process cartridge is constituted by integrating, as a cartridge, developing means as said process means with said electrophotographic photosensitive body, and the cartridge is removably mounted to the main body of the electrophotographic image forming apparatus.

30. An electrophotographic image forming apparatus to which a process cartridge is removably mounted, and which forms an image on a recording medium, comprising:

a. a mount for removably mounting the process cartridge, said mount portion comprising:

an electrophotographic photosensitive body, process means for performing an operation on said electrophotographic photosensitive body, a developing agent storage container for storing a developing agent to be used for developing a latent image formed on said electrophotographic photosensitive body, said developing agent storage container being provided in a main body of the image forming apparatus, an open/close member openable to mount a developing agent supply container onto said developing agent storage container, and a container mount portion to which the developing agent supply container is removably mounted, said container comprising:

an inner cylinder for storing a developing agent, and having a supply opening, an outer cylinder which is arranged outside said inner cylinder and has a supply opening, the developing agent stored in said inner cylinder being able to be supplied to the developing agent storage container when the two supply openings oppose each other, and an inhibition member for inhibiting supply of the developing agent stored in said inner cylinder to said developing agent storage container when said developing agent supply container is removed from a predetermined position of said developing agent storage container, said inhibition member also permitting supply of the developing agent stored in said inner cylinder to said developing agent storage container when said developing agent supply container is mounted at the predetermined position of said developing agent storage container, and said open/close member is closed, said inhibition member comprising a rotation stopper provided to said inner cylinder, the rotation of the rotation stopper being inhibited by abutting against an abutting portion provided to a main body of the image forming apparatus when said developing agent supply container is mounted to a process cartridge and said inner cylinder is rotated, and by rotating said outer cylinder, the two supply openings opposing each other to supply the developing agent stored in said inner cylinder to the developing agent storage container; and b. feeding means for feeding the recording medium.

31. A process cartridge which is removably mounted to a main body of an electrophotographic image forming apparatus, comprising:

an electrophotographic photosensitive body;

a device configured to perform an operation on said electrophotographic photosensitive body;

a developing agent storage container for storing a developing agent to be used for developing a latent image formed on said electrophotographic photosensitive body, said developing agent storage container being provided in a main body of an image forming apparatus having an openable cover permitting mounting of said developing agent supply container onto said developing agent storage container when opened, the openable cover having a projection extending from the bottom surface thereof, said developing agent storage container having an opening therein to receive the projection of the openable cover when the cover is closed; and a developing frame member to which a developing agent supply container is removably mounted, the developing agent supply container comprising:

a developing agent storage portion having an opening portion;

a seal member openably sealing the opening portion, said seal member comprising a grip portion;

a cover member removably covering the grip portion, wherein the seal member can be removed from the opening portion in response to the grip portion being pulled by an operator, wherein, when the covering member covers the grip portion, the grip portion is inaccessible to the operator when said developing agent supply container is mounted on said developing agent storage container so that the operator cannot pull the grip portion to remove the seal member from the opening portion, said cover member comprising a pawl member; and a rotatable arm normally biased into a position to lock said pawl of said cover member so that said cover member is locked into engagement with said grip portion of said seal member, wherein the projection of the openable cover of said image forming apparatus is sufficiently long to contact and press said rotatable arm to rotate said rotatable arm against the bias on said rotatable arm so as to release the pawl of said cover member and permit the cover member to be removed by the operator, thereby exposing the grip portion of said seal member which can be pulled by the operator to remove the seal member from the opening portion and permit the developing agent stored in said developing agent storage portion to be supplied to said developing agent storage container, when said openable cover of said image forming apparatus is closed.

* * * * *

UNITED STATES PATENT AND TRADEMARK OFFICE

CERTIFICATE OF CORRECTION

PATENT NO. : 5,708,925

DATED : January 13, 1998

INVENTOR(S) : KOBAYASHI et al.

It is certified that error appears in the above-identified patent and that said Letters Patent is hereby corrected as shown below:

Column 3

Line 41, "as" should read --with the emitted light as--; and "1c with the emitted" should read --1c--.
Line 42, "light" should be deleted.

Column 9

Line 20, "means" should read --means also--.
Line 39, "a said" should read --said--.

Column 12

Line 17, "cover is open/close" should read --open/close cover is--.

Column 14

Line 14, "container supply" should read --supply container--.

Signed and Sealed this

Twenty-first Day of July, 1998

Bruce Lehman

*Attest:*

BRUCE LEHMAN

*Attesting Officer*

*Commissioner of Patents and Trademarks*